United States Patent [19]

Grof

[11] Patent Number: 4,520,528

[45] Date of Patent: Jun. 4, 1985

[54] VACUUM FOAM REMOVER

[75] Inventor: Geza J. Grof, Fremont, Calif.

[73] Assignee: James Dole Corporation, Redwood City, Calif.

[21] Appl. No.: 517,581

[22] Filed: Jul. 27, 1983

[51] Int. Cl.[3] ..... B67C 1/00; B08B 5/04

[52] U.S. Cl. ..... 15/304; 15/306 B; 15/308; 15/354; 15/401

[58] Field of Search ..... 15/306 R, 306 B, 306 A, 15/308, 401, 354, 304

[56] References Cited

U.S. PATENT DOCUMENTS

| | | | |
|---|---|---|---|
| 2,644,188 | 7/1953 | Pacilio | 15/306 B X |
| 2,677,144 | 5/1954 | Parry | 15/402 |
| 2,917,768 | 12/1959 | Walberer | 15/304 |
| 3,004,276 | 10/1961 | Hoffman | 15/306 R |
| 3,568,238 | 3/1971 | Fischer | 15/306 B |
| 4,420,854 | 12/1983 | Newton | 15/308 X |

*Primary Examiner*—Chris K. Moore

*Attorney, Agent, or Firm*—Julian Caplan

[57] ABSTRACT

A vacuum nozzle draws off foam from the headspace of filled containers as they approach container closers. The nozzle has a substantially rectangular head at its lower end, preferably turned at an angle to the path of the containers. From the head depends a pair of parallel scraper-like blades of rubber-like material. Spaced slits extend upward from the bottom edges of the blades. The upper end of the nozzle leads to a source of vacuum which includes means for salvaging the liquid content of the foam for re-use.

11 Claims, 6 Drawing Figures

VACUUM FOAM REMOVER

This invention relates to a new and improved vacuum nozzle construction for use in removing foam from the headspace of containers preparatory to closing or "seaming" the containers.

The headspace of containers filled with liquid frequently contains bubbles of air in the form of foam. Juices, such as orange juice, characteristically have such foam. After passage of time, the oxygen in the foam deleteriously affects the taste and appearance of the liquid.

Immediately prior to application of the container closure, the headspace (i.e., the space between the top of the liquid and the top of the container) is frequently filled with an inert gas, such as nitrogen, which displaces the oxygen normally present in the headspace. If there is foam in the headspace, however, this prevents the nitrogen from displacing some of the oxygen.

Heretofore, nozzles have been installed in the container closing equipment which blow nitrogen across the headspace and attempt to blow the foam out of the container. However, such nozzles have generally been unsatisfactory and the foam blown inside the closing equipment tends to create undesirable sticky deposits.

The present invention provides means for drawing the foam out of the container. However, such nozzles have generally been unsatisfactory and the foam blown inside the closing equipment tends to create undesirable sticky deposits.

The present invention provides means for drawing the foam out of the headspace by vacuum and also using flexible blades, preferably slitted, to wipe the foam off the tops of containers.

A feature of the invention is the fact that by drawing the foam away prior to the containers entering the closing equipment, the liquid content of the foam may be salvaged by separating from the air and then reusing the liquid by returning it to the filler tank. Further, the foam is removed before the containers enter the closing apparatus and hence no sticky deposit is formed thereon.

Further features of the equipment hereinafter described are that the bottom edge of the blade is adjustable in height to compensate for different container heights and also for wear of the blade.

Another feature of the invention is the fact that the angle of the blade to the path of movement of the containers is adjustable, so that the blade angle may be varied to obtain the most effective angle for the product being packed.

A still further feature of the invention is the fact that, after the foam has been removed, the headspace tends to be uniform. Hence, when the headspace is subsequently filled with nitrogen, the amount of nitrogen required per container is more uniform than otherwise would be the case. Uniform filling of containers is, of itself, desirable.

A preferred use of the present invention is in aseptic canning wherein the container and the contents are maintained in an atmosphere of hot sterilizing air or steam at greater than atmospheric pressure. The apparatus hereinafter described may be installed as a unit in the line along which the containers pass between the filler and the container closure. The unit maintains the same pressure and sterility as in other portions of the aseptic canning system.

Another feature of the invention is the fact that the cover of the unit may be provided with a window so that the operator may observe the conditions of the containers passing through the unit. Preferably, the entire unit is hinged to the side wall of the tunnel through which the containers pass to provide rapid access to the containers in the event of jamming.

Other objects of the present invention will become apparent upon reading the following specification and referring to the accompanying drawings in which similar characters of reference represent corresponding parts in each of the several views.

Figure 1:
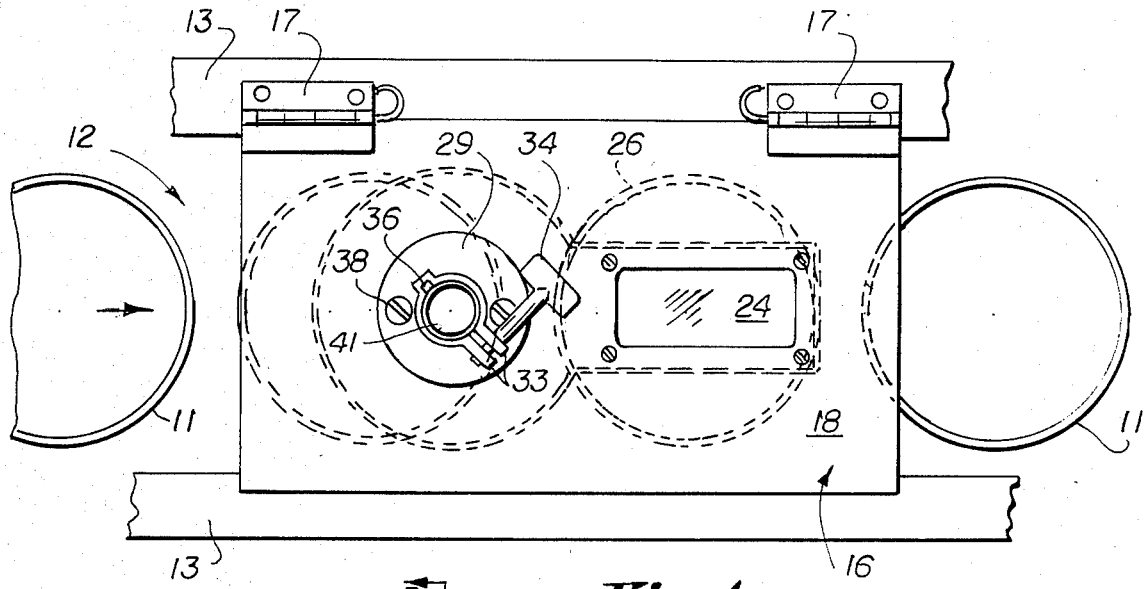
FIG. 1 is a top plan view of the apparatus of the present invention installed in a tunnel of an aseptic canning line.

The present invention is used in the processing of filled containers 11 here shown as flanged open-mouthed cans of fiber. It will be understood that containers of other structures may be used. At a previous station, the containers 11 have been filled with a liquid, such as orange juice, which tends to foam during the filling process so that the container headspace is filled with foam. At a subsequent station, after removal of the foam in the station which is the subject of the present invention, preferably the headspace of the present container is filled with an inert gas and then a closure, such as a metal can end, is applied to the container 11 and "seamed" thereon. It will be understood, however, that the usage of the present invention is subject to wide variation.

In the preferred embodiment illustrated and hereinafter described, the apparatus is installed in an aseptic canning line wherein the containers and their contents are maintained in sterile condition in an atmosphere of sterile air (or steam) at above atmospheric pressure to prevent contaminating air from entering the apparatus. Thus, in accordance with the preferred aseptic canning embodiment of the invention, the containers 11 pass at spaced intervals along a tunnel 12 shown partially in FIG. 1. Tunnel 12 has double thickness side walls 13 suitably insulated. The foam remover unit of the present invention is mounted under a cover 16 which is hinged at one side edge to one of the walls 13 by hinges 17. Cover 16 has a top wall 18 and a spaced bottom wall 19. Along each longitudinal edge, is a side wall 21 which fits immediately within the wall 13 and an inwardly spaced inner wall 12. Insulation 23 fills the space between walls 18 and 19 and 21 and 22. A window 24 may be installed in top wall 18 to observe the condition of the containers passing through the unit and, in such event, a suitable hole is formed in the bottom wall 19 for purpose of observation. An arcuate, substantially circular, wall 26 is attached to the underside of top wall 18, the diameter of wall 26 being somewhat greater than the diameter of the containers 11. The area between walls 18 and 19 and outside of wall 26 is also suitably insulated (not shown). The forward and rearward ends 27 of the cover 16 may be slanted, as best shown in FIG. 2.

A circular hole (not shown) is formed concentric with the wall 26. An annular clamp ring 29 fits over a split flange 31 which fits against the top of top wall 18 surrounding the hole therein. Extending upwardly from split flange 31 is a split hub 32. Hub 32 has ears 33 through which fits a wingbolt 34. The split hub 32 is formed with a key-way 36. Arcuate slots 37 concentric with wall 36 are formed in top wall 18. Below top wall 18 is a second clamp ring 42. Screws 38 fit through holes in the clamp ring 29 and flange 31 and pass through the slots 37 to engage ring 42. By tightening screws 38, a pressure-tight joint is obtained.

Tube 41 fits through the split hub 32 and flange 31 extends below the cover 16. Spacers 43 are secured to the tube 41 below ring 42. A key 44 fixed to spacers 43 extends up into the key-way 36, so that hub 32 and tube 41 are in angular relationship to each other.

Figure 5A:
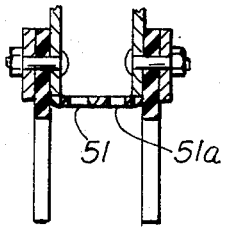
FIG. 5 is an enlarged, fragmentary sectional view taken substantially along the line 5—5 of FIG. 3.

Nozzle 46 fixed to tubes 41 and spacers 43, has outwardly flared ends 47 and generally diverges downwardly. On the lower end of nozzle 46 is an elongated rectangular bottom frame 48 partially closed off with a horizontal bottom 49 having a slot 51 adjacent one edge thereof (i.e., the upstream edge of the passage of the containers). In the modification of FIG. 5A, plural parallel slots 51, 51*a* on opposite edges of bottom 49 may be formed.

Along the outside of the rectangular bottom frame 49 are flexible blades 56 of a rubber or rubber-like material formed with slits 57 extending upward from their bottom edges. The blades 56 may be attached to the frame 48 by clamp strips 55. Bolts 59 extend from the inside of the nozzle 46 through holes in the blades 56 and similar holes in the strips 58 and are held in place by nuts 61.

The tube 41 and hence the nozzle 47 and blade 56 may be raised and lowered to accommodate changes in height of containers 11 by loosening the wingbolt 34 and then moving the tube 41 upward or downward as required. The same adjustment, but of minor degree, may be made as the blades 56 wear. It is desirable that the blades 56 be located at an angle across the path of movement of the containers 11, rather than being perpendicular to the path. The arcuate slots 37 permit adjustment of such angle. Thus the screws 38 are loosened and the hub 32 turned so that the blades 56 assume the proper angle. Thereupon the screws 38 are tightened.

Figure 2:
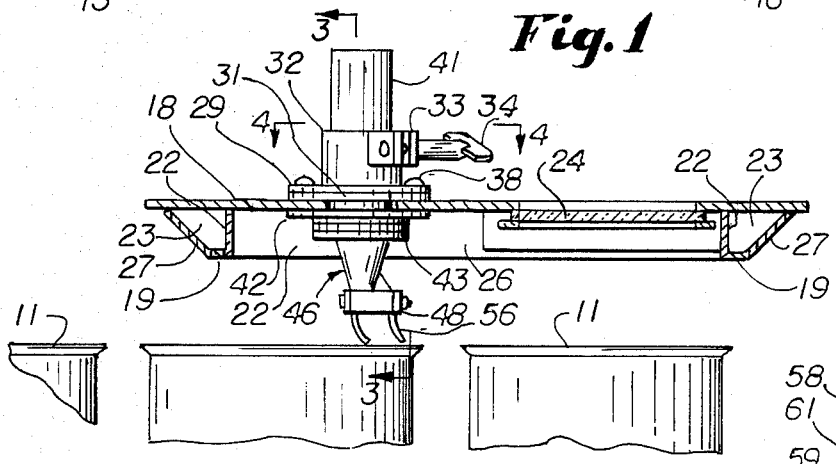
FIG. 2 is a vertical sectional view thereof.
Figure 5:
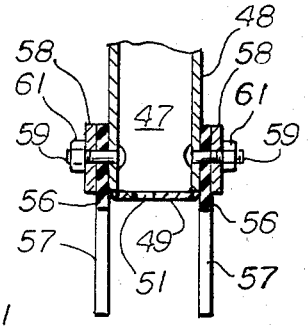
Figure 3:
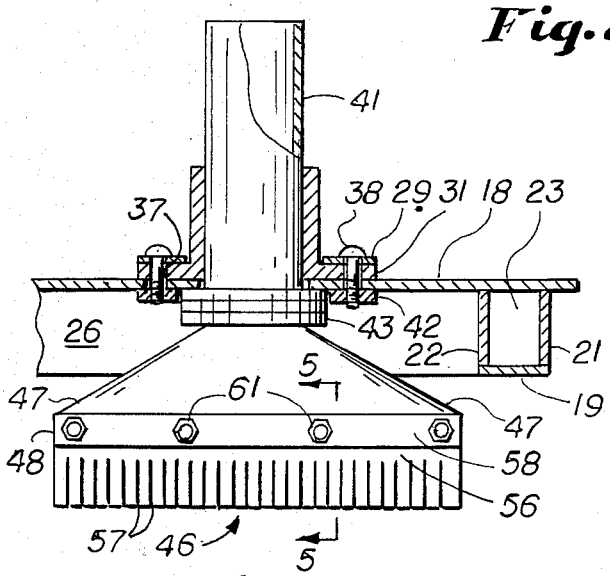
FIG. 3 is a transverse vertical sectional view in enlarged scale taken substantially along the line 3—3 of FIG. 2.
Figure 4:
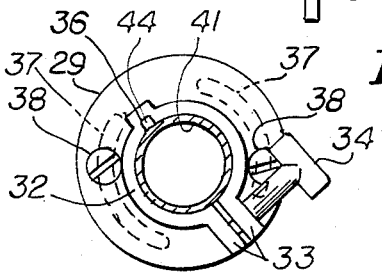
FIG. 4 is a view taken substantially along the line 4—4 of FIG. 2.

The filled containers, having foam in the headspace, pass from left to right as viewed in FIG. 1, being moved along by a conveyor (not shown). As the top edges of the containers 11 pass the blades 56, they bend the blades to the right, as viewed in FIG. 2. A vacuum hose is attached to the upper end of tube 41 and this pulls a vacuum through the slot 51 between the blades 56 (see FIG. 5) drawing the foam out of the container headspace. Plural slots 51,51*a* (FIG. 5A) function in similar manner. The blades 56 insure that the effect of the vacuum drawn through the tube 41 will be confined primarily to the headspace of the can, rather than the general area of the tunnel 12. The slits 57 promote flexibility and also provide fingers on the blades 56 between the slits 57 which wipe the foam off the tops of the containers 11. It has been found that the headspace is much more uniform after passing through the equipment of the present invention than has been the case with prior methods which blow the foam out of the headspace. Furthermore, the liquid in the foam drawn off through tube 41 may be reclaimed and refilled into subsequent containers.

What is claimed is:

1. A vacuum foam remover comprising a nozzle extending across the path of containers as they move between filling and closing stations, support means supporting said nozzle above said path, vacuum means for drawing a vacuum through said nozzle, and a substantially rectangular frame at the bottom of said nozzle extending across said path, first and second parallel sides of said frame being substantially transverse to said path and substantially longer than the third and fourth sides of said frame.

2. A foam remover according to claim 1 in which said nozzle has a tube on its upper end, said vacuum means being connected to said tube and said support means comprises a collar through which said tube extends.

3. A foam remover according to claim 2 in which said collar is split and further comprises means for drawing said collar tight about said tube, whereby when said collar is relaxed said tube may be raised and lowered and when said collar is drawn tight said tube is held in place.

4. A foam remover according to claim 2 in which said support means comprises a horizontal member apertured for said tube and cooperating means on said horizontal member and said collar to hold said nozzle in a plurality of angles relative to the path of said containers.

5. A foam remover according to claim 1 which further comprises an insulated tunnel through which said containers are transported, said support means comprising a horizontal member forming a part of the top of said tunnel.

6. A foam remover according to claim 5 in which said horizontal member is formed with a window for observing movement of containers past said nozzle.

7. A foam remover according to claim 6 which further comprises hinge means attaching said horizontal member to said tunnel, whereby said foam remover may be pivoted upward to provide access to said tunnel.

8. A vacuum foam remover comprising a nozzle extending across the path of containers as they move between filling and closing stations, support means supporting said nozzle above said path, vacuum means for drawing a vacuum through said nozzle, a substantially rectangular bottom frame at the bottom of said nozzle, a longitudinal flexible blade fixed to one longitudinal side of said frame and extending down to slightly below the level of the tops of said containers.

9. A foam remover according to claim 8 in which said blade is formed with a plurality of slits extending up from its bottom edge dividing the lower part of said blade into a plurality of fingers.

10. A foam remover according to claim 8 which further comprises a second blade fixed to the side of said frame opposite said first-mentioned blade, said blade being substantially the same as said first-mentioned blade.

11. A foam remover according to claim 10 which further comprises a bottom for said nozzle between said blades, said bottom formed with at least one elongated slot located near one of said blades.

* * * * *